US008046938B1

(12) United States Patent
Jorgenson et al.

(10) Patent No.: US 8,046,938 B1
(45) Date of Patent: Nov. 1, 2011

(54) IMPLEMENT ATTACHING APPARATUS

(75) Inventors: Kristopher J. Jorgenson, Red Lake Falls, MN (US); Shane R. Voxland, McIntosh, MN (US)

(73) Assignee: Quick Attach Attachments, Inc., Alexandria, MN (US)

( * ) Notice: Subject to any disclaimer, the term of this patent is extended or adjusted under 35 U.S.C. 154(b) by 491 days.

(21) Appl. No.: 11/923,090

(22) Filed: Oct. 24, 2007

Related U.S. Application Data

(63) Continuation of application No. 10/945,054, filed on Sep. 20, 2004, now Pat. No. 7,302,765.

(51) Int. Cl.
*E01H 5/04* (2006.01)

(52) U.S. Cl. ..... 37/231

(58) Field of Classification Search ..... 37/231, 37/235, 468; 172/605, 439, 677–681, 63, 172/795, 829
See application file for complete search history.

(56) References Cited

U.S. PATENT DOCUMENTS

| | | | | | |
|---|---|---|---|---|---|
| 2,163,279 | A | * | 6/1939 | Henry et al. | 37/231 |
| 2,426,410 | A | * | 8/1947 | Owen | 37/231 |
| 2,659,572 | A | * | 11/1953 | Steer | 254/124 |
| 3,199,236 | A | * | 8/1965 | Bartel et al. | 172/817 |
| 3,226,860 | A | * | 1/1966 | McGee | 172/817 |
| 3,588,147 | A | * | 6/1971 | Enters | 80/481 |
| 3,688,847 | A | * | 9/1972 | Deeter | 172/817 |
| 3,800,882 | A | * | 4/1974 | Werts et al. | 172/273 |
| 4,369,590 | A | * | 1/1983 | Miller | 37/231 |
| 4,470,211 | A | * | 9/1984 | Rossmann | 37/231 |
| 4,554,978 | A | * | 11/1985 | Schneider | 172/247 |
| 4,615,130 | A | | 10/1986 | Racicot | |
| 4,790,085 | A | * | 12/1988 | Rossman | 37/231 |
| 4,825,570 | A | * | 5/1989 | Schmid et al. | 37/231 |
| 4,996,783 | A | * | 3/1991 | Fresia | 37/245 |
| 5,046,271 | A | | 9/1991 | Daniels | |
| 5,329,708 | A | | 7/1994 | Segorski et al. | |
| 5,381,647 | A | * | 1/1995 | Eberle | 56/15.8 |
| 5,479,730 | A | | 1/1996 | Gogan | |
| 5,662,451 | A | * | 9/1997 | Muzzi et al. | 414/540 |
| 5,887,634 | A | * | 3/1999 | Theisen | 144/334 |
| 5,950,336 | A | | 9/1999 | Liebl | |
| 6,102,131 | A | * | 8/2000 | Malinowski | 172/273 |

(Continued)

OTHER PUBLICATIONS

Office Action of U.S. Appl. No. 10/945,054 mailed Sep. 26, 2006.

(Continued)

*Primary Examiner* — Robert Pezzuto
(74) *Attorney, Agent, or Firm* — DuFault Law Firm, P.C.; Dustin R. DuFault

(57) ABSTRACT

An apparatus for connecting to an all-terrain vehicle (ATV) a mechanized implement operatively connected to an auxiliary power source includes rigid frame connectable to an undercarriage of the ATV. The frame includes a first portion extending past the front axle of the ATV and a second portion extending past the rear axle of the ATV. The first portion of the frame connects to the undercarriage proximate the front axle, while the second portion of the frame connects to the hitch. A base connects to the second portion of the frame to support the auxiliary power source. The mechanized implement attaches to the frame by way of a swingable portion having a first end pivotally attached to the first portion of the frame and a second end mateable with the mechanized implement. The swingable portion is positionable to position the mechanized implement between a working position and a non-working position, wherein only the ATV engages the ground when the mechanized implement is positioned towards the non-working position.

20 Claims, 6 Drawing Sheets

U.S. PATENT DOCUMENTS

| | | | | |
|---|---|---|---|---|
| 6,178,668 | B1 | 1/2001 | Gustafson et al. | |
| 6,334,269 | B1 * | 1/2002 | Dilks | 37/235 |
| 6,336,281 | B2 | 1/2002 | Fulton, III | |
| 6,453,582 | B1 | 9/2002 | Fulton, III | |
| 6,519,880 | B2 * | 2/2003 | Robitaille | 37/231 |
| 6,557,330 | B2 * | 5/2003 | Hubscher | 56/10.8 |
| 6,609,481 | B1 * | 8/2003 | McCarty | 119/843 |
| 6,634,588 | B1 | 10/2003 | Jackson | |
| 6,732,811 | B1 | 5/2004 | Elliott | |
| 6,931,770 | B2 * | 8/2005 | Belzile | 37/231 |
| 6,932,555 | B2 * | 8/2005 | Dale et al. | 414/607 |
| 6,964,121 | B2 * | 11/2005 | Harris | 37/231 |
| 7,093,380 | B2 * | 8/2006 | Hubscher et al. | 37/231 |
| 2002/0078672 | A1 * | 6/2002 | Hubscher | 56/14.7 |

OTHER PUBLICATIONS

Amendment filed on Nov. 2, 2006 in response to aforementioned Office Action.

Office Action (Final) of parent application mailed Jan. 26, 2007.

Amendment (After Final) filed on May 15, 2007 in response to aforementioned Office Action (Final).

* cited by examiner

IMPLEMENT ATTACHING APPARATUS

CROSS-REFERENCE TO RELATED APPLICATION(S)

This application is a Continuation of U.S. patent application Ser. No. 10/945,054 entitled IMPLEMENT ATTACHING APPARATUS filed on 20 Sep. 2004 which is incorporated herein by reference.

BACKGROUND OF INVENTION

The present invention generally relates to all-terrain vehicles. In particular, the present invention relates to an apparatus for attaching mechanized implements to an all-terrain vehicle.

An all-terrain vehicle (hereinafter "ATV") is a motorized vehicle that typically allows travel over varying types of terrain. ATVs are well known in the art and have been in existence for well over thirty years. While originally invented as work vehicles, over the past three decades ATVs have taken on a role primarily as recreational vehicles. However, as the prior-art demonstrates, interest in ATVs as work vehicles has always existed and has been waxing over the last decade, especially in the field of attaching implements to the ATV for doing yard-work or other non-industrial tasks. Examples of implements that have been employed utilizing the work capabilities of an ATV include herbicide/fungicide applicators, snow or push blades, lawn mowers, mechanized brooms, snow removal devices and the like. As such, there exists in the prior art many examples that demonstrate how to attach an implement to an ATV. Such examples include devices that allow the implement to be attached to either the front or rear end of the ATV. Of the examples listed, mechanized implements have been taking on a greater role as they allow the ATV to be utilized as a work vehicle as well as a recreational vehicle, thereby broadening the appeal of an ATV to a greater market.

Mechanized implements, however, generally need a power source other than the ATV engine in order to ideally operate. Most ATVs are not equipped with power take-off devices to operate mechanized implements, nor would it be feasible in most cases to do so. Revving the ATV engine at a high speed, which is generally required in order to provide sufficient power to the mechanized implement, does not allow for adequate control of the ATV as their transmissions are not geared for that type of work. Alternatively, the engine may not have the desired output power to drive both the ATV and the mechanized implement. Therefore, auxiliary power sources are desirable to run certain mechanized implement attachments.

Because of the additional moving parts, and the need for an auxiliary power source, mechanized implements tend to be more massive than non-mechanized implements. As such, the attachments of the prior art typically provide a ground engaging means, other than the ATV, to help support the mechanized implement. For example, U.S. Pat. Nos. 5,381,647 and 6,178,668 disclose front-attachable implements that connect to the ATV, but also include ground-engaging wheels, other than the ATV wheels, to help support for example, a mowing implement or a snow removal implement. These wheels are continuously engaged with the ground as long as the implement is attached to the ATV. This type of attachment is disadvantageous in that it hinders both the control of the ATV and does not allow for adequate mobility of the ATV during speeds in excess of normal operating conditions while using the attached implement. The control of the ATV is hindered by the additional ground-engaging wheels which impede the maneuverability of the ATV; the more massive the mechanized implement, the lesser maneuverability of the ATV. Alternatively, and again taking U.S. Pat. Nos. 5,381,647 and 6,178,668 as examples, transportation from one job site to another is greatly hindered by the ground-engaging wheels of the attachment which are generally designed for one type of terrain and not for transportation on gravel roads, highways or other uneven terrain, thereby defeating the purpose of having an all-terrain vehicle.

Also, most applications for use with an ATV having an attached implement involve residential applications, including regular yard-work, removing snow from driveways, and the like that can be typically done by a single person. And given the dual nature of ATVs in that they are used as both recreational vehicles and work vehicles, it is desirable to be able to transfer between each application with relative ease. Attachments of prior art generally require fastening to the ATV in such a manner that is both time consuming and difficult for a single person to accomplish, especially considering that many do not allow the ATV to function as a recreational vehicle when an attachment is connected thereto.

BRIEF SUMMARY OF INVENTION

The present invention includes an implement attaching apparatus for connecting a mechanized implement and an auxiliary power source to an ATV. The implement attaching apparatus includes a rigid frame longitudinally disposable along an underside of the ATV proximate the undercarriage. The frame attaches at a forward position and a rearward position. The forward position includes pin members attached to the frame which are disposable within apertures of a bracket connected to the undercarriage proximate a front axle of the ATV. The pins allow for slidable forward and rearward movement of the frame while connected to the forward position. After attaching the frame at the forward position, the frame is secured to the ATV by connection at the rear position. Attachment at the rear position includes a device cooperably mateable with a hitch attached to the ATV. Upon attaching the frame to the ATV at the rear position, the frame is secured and slidable rearward or forward movement is not permitted.

The implement attaching apparatus further includes a swingable portion attached to the frame for mateable connection to the mechanized implement. An auxiliary power source mounted on the rear portion of the frame operatively connects to the mechanized implement by way of an output shaft and secondary shaft. The mechanized implement is positionable between a lowered working position and a raised non-working or transport position. When in the raised non-working or transport position, neither the mechanized implement nor the implement attaching apparatus engages the ground.

DETAILED DESCRIPTION

Figure 1:
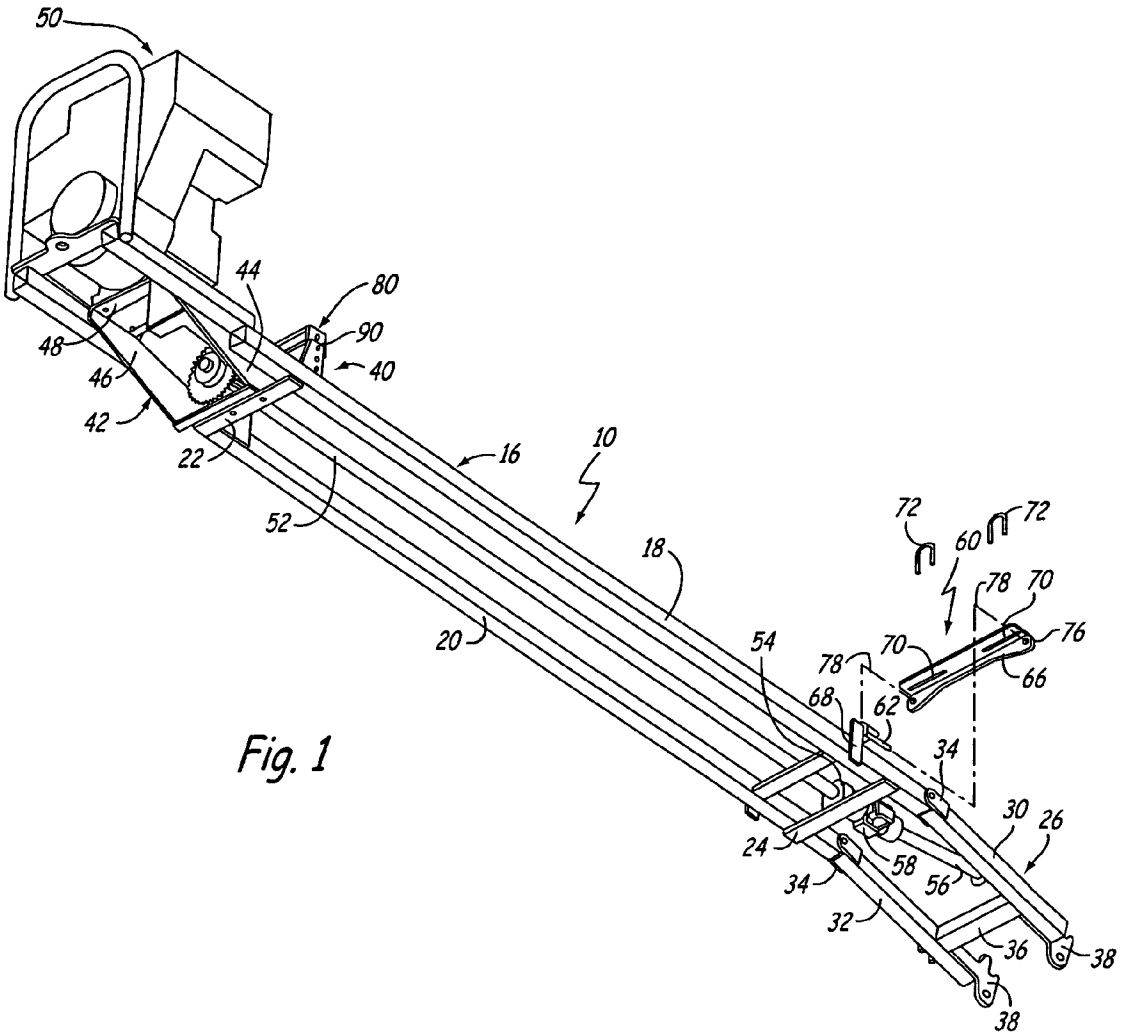
FIG. 1 is a perspective view of an implement attaching apparatus of the present invention.
Figure 2:
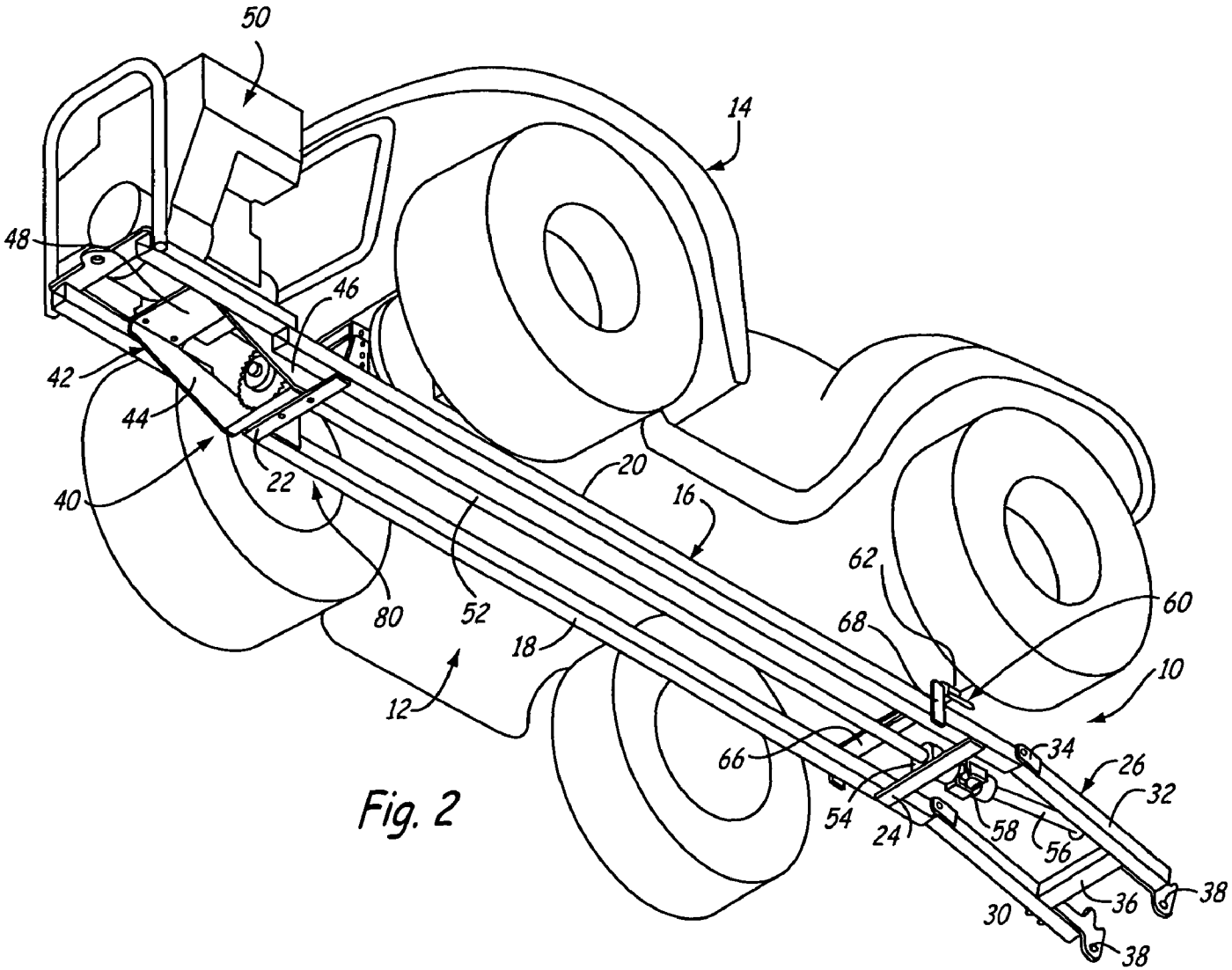
FIG. 2 is a perspective view of the implement attaching apparatus of the present invention connected to an undercarriage of an ATV.

The implement attaching apparatus 10 of the present invention is generally indicated at 10 in FIG. 1. The implement attaching apparatus 10 connects to an undercarriage 12 of an ATV 14, as illustrated in FIG. 2. The implement attaching apparatus 10 includes a rigid frame 16 having a first longitudinal member 18 and a second longitudinal member 20, each member 18 and 20 spaced-apart a fixed distance by attached first and second cross members, 22 and 24 respectively. Each longitudinal member, 18 and 20, is preferably of tubular construction, having a square cross-section. However, other types of members are well within the scope of the present invention, including but not limited to, circular tubular members, non-tubular members, channel members, "L"-shaped or angle members, flat members and the like.

Figure 5:
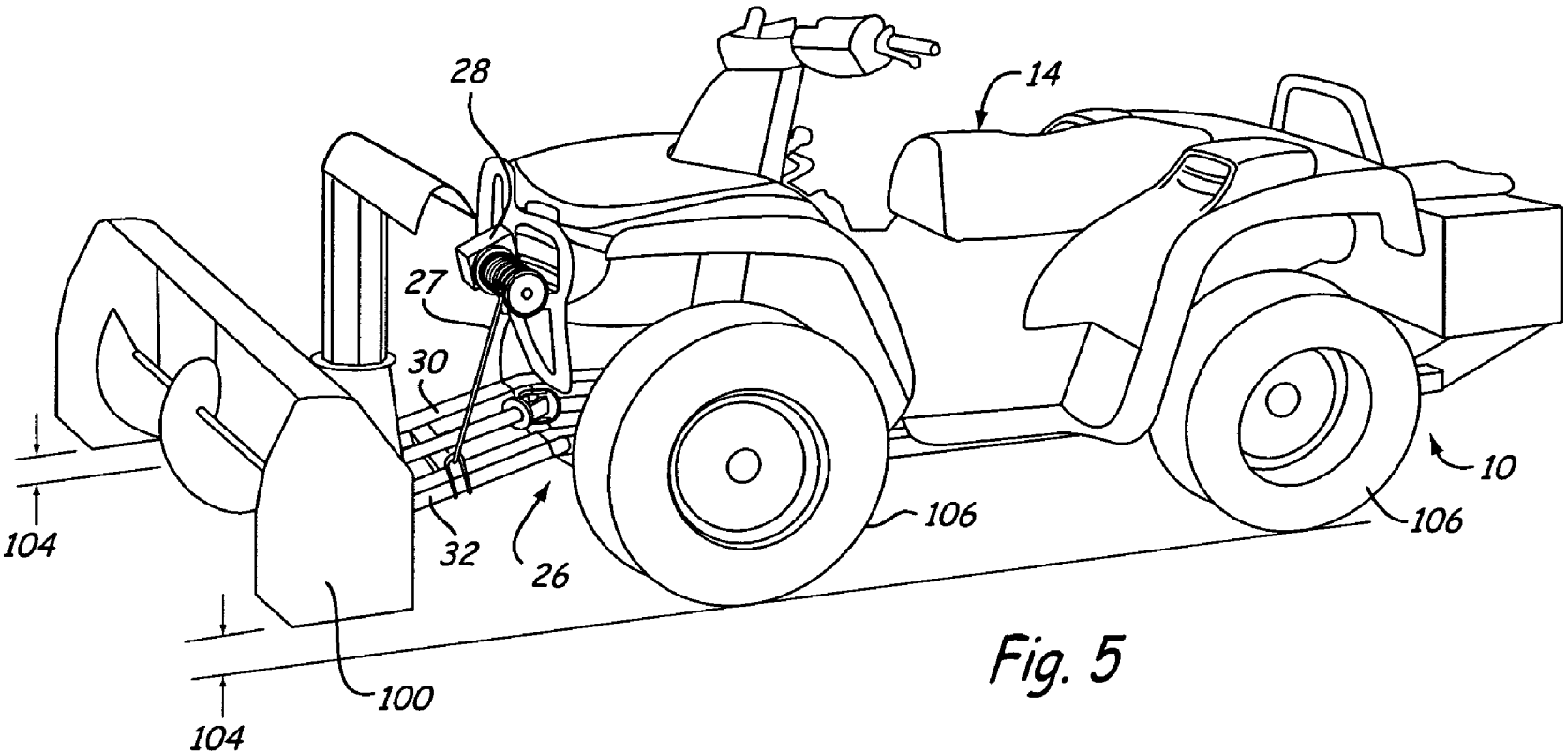
FIG. 5 is a perspective view of a snow removal implement connected to an ATV by the implement attaching apparatus of the present invention.
Figure 6:
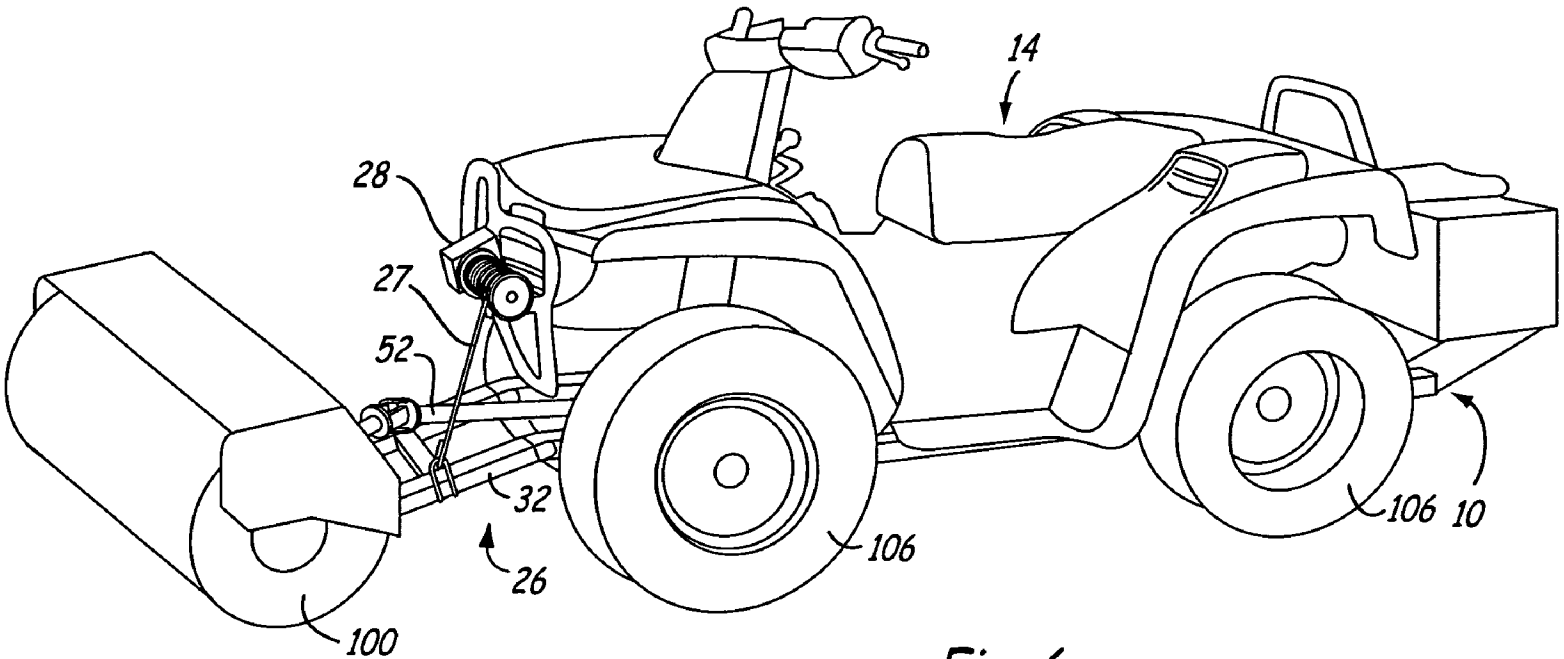
FIG. 6 is a perspective view of a mechanized broom implement connected to an ATV by the implement attaching apparatus of the present invention.

Pivotally attached to a first end of the frame 16 is a swingable portion 26 for connecting an implement 100 to the frame 16. The swingable portion 26 is pivotal in relation to the frame 16 to allow raising and lowering of the attached implement. As illustrated in FIGS. 5 and 6, the raising and lowering of the swingable portion 26 is accomplished by means of a winch 28 connected to the ATV 14 and swingable portion 26 by cable 27. It should be noted, however, that other mechanical means for raising and lowering the swingable portion 26 are also within the scope of the present invention, including but not limited to levers, cranks, actuators and hydraulic cylinders. The pivotability of the swingable portion 26 further allows selective positioning to attach or detach the implement.

Figure 3:
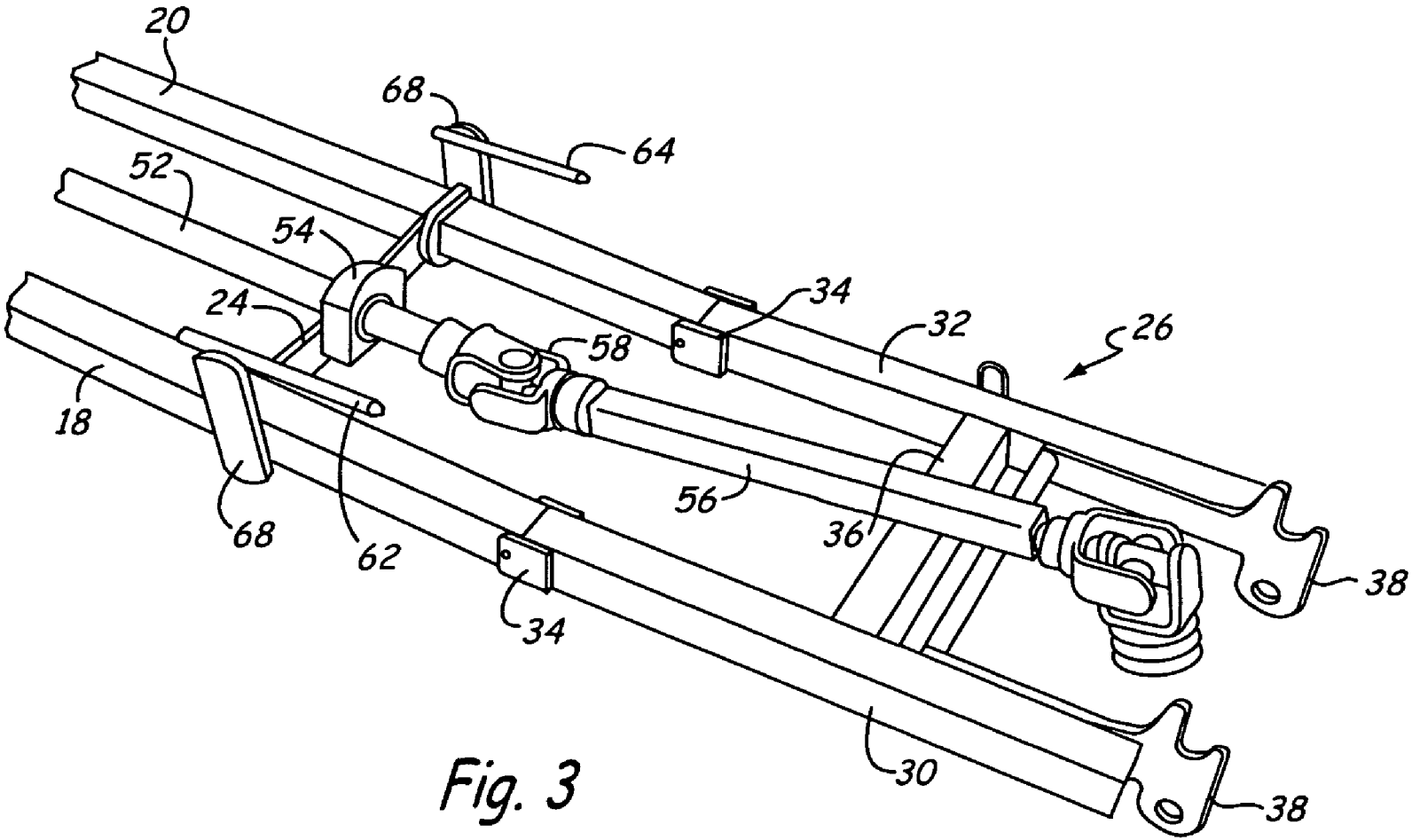
FIG. 3 is a perspective view of a forward portion of the implement attaching apparatus of the present invention.

Referring now to FIG. 3, the swingable portion 26 includes first and second arms, 30 and 32 respectively, spaced apart approximately the width of the frame 16. Each arm 30 and 32 includes a terminally placed clevis 34 attached to a proximal end which allows pivotal attachment to the respective longitudinal member, 18 and 20. In a preferred embodiment of the present invention, a connecting cross member 36 attaches to each arm 30 and 32 to provide rigidity to the swingable portion 26. In an alternative embodiment of the present invention, each arm 30 and 32 is allowed to pivot independent of one another, allowing the attached implement 100 to float over uneven terrain. A cable attached to each arm 30 and 32 is in turn connected to the winch 28 to raise and/or lower the swingable portion.

To connect the implement 100 to the swingable portion 26, a quick-attach device 38 disposes between terminal ends of each arm 30 and 32 proximate the cross member 36. Alternatively, the quick attach device 38 is attached on an outside surface of each arm 30 and 32. Such quick attach devices are well known in the art and typically include a notched area and aperture for engaging cooperable members attached to the implement. The quick attach device 38 may be approximately "U"-shaped and disposable between each arm 30 and 32 and engaged to the connecting cross-member 36 for added support. It should be noted, however, that other types of quick attach devices are well within the scope of the present invention, including any device that allows for cooperable mateability to attach an implement to the swingable portion 26 in such a manner.

As illustrated in FIGS. 1 and 2, a second rear end 40 of the frame 16 includes a motor mount 42 attached thereto. The motor mount 42 includes a first strut member 44 attached to and extending away from the first longitudinal member 18. A second strut member 46 attaches to and extends away from the second longitudinal member 20. Preferably, the strut members 44 and 46 are fixedly attached to the frame 16. However, it is well within the scope of the present invention to attach the strut members 44 and 46 by removable fastening means, thereby allowing the entire motor mount to be removed from the frame 16. A support plate 48 disposes between each strut member 44 and 46, thereby forming a base to support an auxiliary power source 50. The auxiliary power source is preferably an internal-combustion engine operatively connected to an output shaft 52. The output shaft 52 connects to the auxiliary power source 50 at a proximal end and disposes between the first and second longitudinal members, 18 and 20 respectively, of the frame 16. The output shaft 52 is held in place by housed bearings 54 connected to the cross members of the frame 16. Preferably, a distal end of the output shaft 52 connects to a second shaft 56 by way of a universal joint 58, as illustrated in FIG. 3. The second shaft 56 is mateable with a mechanized implement 100, thereby operatively engaging the auxiliary power source 50 with the mechanized implement 100.

To connect the frame 16 to the ATV 14, two connecting devices are supplied. A first forward connecting device 60 is positioned proximate the first end of the frame 16 and includes first and second pin members, 62 and 64 respectively, attached to the frame 16 along with a bracket member 66 securable to the undercarriage 12 of the ATV 14 for receiving the pin members 62 and 64. The first pin member 62 connects to the first longitudinal member 18, while the second pin member 64 connects to the second longitudinal member 20. Each pin member 62 and 64 extends substantially parallel towards the first end of the frame 16 while being connected at a proximal end to the respective longitudinal member, 18 and 20, by means of a spacing plate 68. By substantially parallel it is meant that the length of each pin 62 and 64 is spaced apart an equal distance from the respective longitudinal members, 18 and 20, however variation within this distance may fluctuate such that each pin member 62 and 64 is positioned at a slight angle with respect to each longitudinal member, 18 and 20. The bracket member 66 connects to the undercarriage 12 of the ATV 14 preferably proximate the front axle of the ATV 14. The bracket 66 is preferably "L"-shaped, having apertures 70 which receive fasteners 72 for attachment to the undercarriage 12 of the ATV 14. The apertures 70 may be circular or elongated. The fasteners 72 are preferably "U"-shaped bolts that can either be positioned about existing members in the undercarriage of the ATV 14. Alternatively, the fasteners 72 can include bolts disposable within apertures drilled into the undercarriage 12. Each fastener 72 disposes within the respective aperture 70, securing the bracket 66 to the undercarriage 12 of the ATV 14 by way of cooperating burrs 74. The apertures 70 allow the bracket member 66 to be selectively positioned transversely relative to the ATV 14, thereby allowing the first end of the frame 16 to be positioned relative to the undercarriage 12 of the ATV 14. The bracket member 66 further includes downwardly extending members 76, each containing a receiving aperture 78 for receiving the respective pin member 62 and 64. Each receiving aperture 78 may be circular or elongated.

Figure 4:
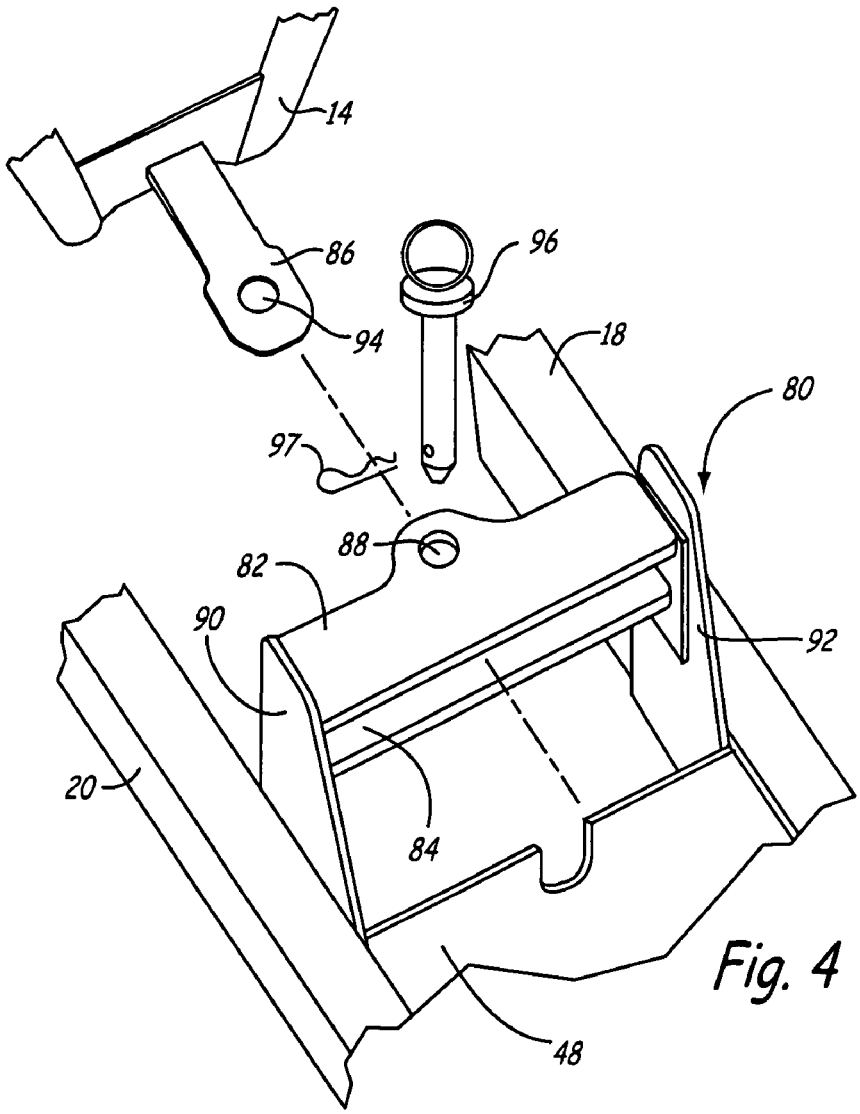
FIG. 4 is a perspective view of a connecting device of the implement attaching apparatus of the present invention.

Attached to the second rear end of the frame 16 is a second rear connecting device 80, as illustrated in FIG. 4. The rear connecting device 80 includes upper and lower spaced-apart plates, 82 and 84 respectively, for receiving a hitch member 86, as illustrated in FIG. 4. Each plate 82 and 84 includes an aperture 88 and is attached at terminal ends to first and second side members, 90 and 92 respectively. Each respective side member 90 and 92 is attached to the respective first and second longitudinal members, 18 and 20 respectively, of the frame 16. The first and second side members 90 and 92 may be permanently attached, or attached by removable fastening means. The hitch member 86 also includes an aperture 94 alignable with the apertures 88 of the upper and lower plates, 82 and 84 respectively, for receiving a fastening means 96 therethrough to secure the rear connecting device 80 to the hitch 86 of the ATV 14. The fastening means 96 may include a pin secured by a cotter pin 97. It should be noted, however, that other fastening means 96 are well within the scope of the present invention, including a threaded bolt and cooperable burr.

To mount the implement attaching apparatus 10 to the ATV 14, the bracket 66 of the forward connecting device 60 is installed by being attached to the undercarriage 12 of the ATV 14 proximate the front axle. The implement attaching apparatus 10 is positioned on the ground beneath the ATV 14 such that the first connecting device 60 is proximate the front axle of the ATV 14, and the second connecting device 80 is proximate the hitch 86 of the ATV 14. An operator then positions the frame 16 such that the pins 62 and 64 of the forward connecting device 60 are aligned with the respective apertures 78 of the bracket 66. Upon alignment, the frame 16 is positioned such that each pin 62 and 64 inserts within and slidably engages the respective aperture, whereupon the forward portion of the frame 16 is slidably connected to the ATV 14 by the first connecting device 60. When slidably connected to the ATV 14, the frame 16 is allowed both slight forward and rearward movement, which enables the operator to attach the rear portion of the frame 16 to the hitch 86 of the ATV 14 with relative ease. This is accomplished by the operator positioning the second end of the frame 16 such that the hitch member 86 attached to the ATV 14 is disposed between the upper and lower plates, 82 and 84 respectively, of the rear connecting device 80. The operator then aligns the respective apertures 88 of the upper and lower plate 82 and 84 with the hitch aperture 94 and inserts the fastening means 96 therethrough to secure the rear portion of the frame 16 to the ATV 14. As stated, the pins 62 and 64 of the first connecting device 60, when slidably seated within the respective aperture 78 of the bracket 66, allow for slidable movement of the frame 16 such that a single operator can connect and disconnect the implement attaching apparatus 10 to the ATV 14 in a quick and efficient manner. To disconnect the implement attaching apparatus 10, the fastening means 96 is removed from the rear connecting device 80 and hitch 86, thereby allowing the operator to position the frame 16 to disengage the rear connecting device 80 from the hitch 86. The operator then positions the frame 16 to disengage the pins 62 and 64 from the respective aperture 78, thereby disconnecting the implement attaching apparatus 10 from the ATV 14.

Figure 4A:
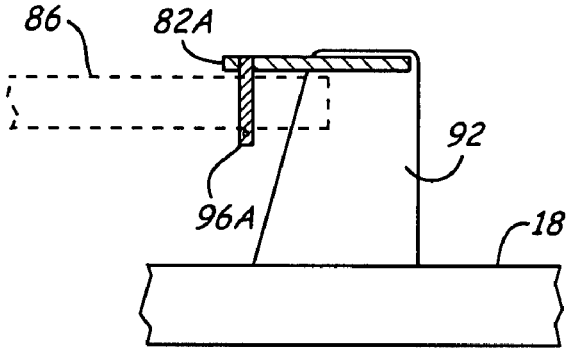
FIG. 4A is a side view of an alternative embodiment of a connecting device of the implement attaching apparatus of the present invention.

FIG. 4A illustrates an alternative embodiment of the second connecting device 80A. The alternative rear connecting device 80A includes a plate 82A for engaging the hitch member 86. The plate 82A connects to the frame 16 in the same manner as the first embodiment illustrated in FIG. 4, of which only side plate 92 and first longitudinal member 18 is illustrated in FIG. 4A. A pin member 96A attaches to the plate 82A and extends downward. Preferably, the pin member 96A is permanently attached, either by way of a weld or similar attaching means. However, it is well within the scope of the present invention to provide for the pin member 96A to be removable from plate 82A. To secure the rear portion of the frame 16 to the hitch 86 utilizing rear connecting device 80A, the rear portion of the frame is simply positioned to dispose pin member 96A within the aperture 44 of the hitch 86. Upon doing so, the plate 82A of the rear connecting device 80A engages and rests up the hitch member 86. The weight of the frame 16, in addition to the weight of the auxiliary power source 50 prevents the rear connecting device 80A from disengaging from the hitch 86. However, a cotter pin (not shown) can also be secured to the pin member 96A to prevent disengagement as well.

Upon attaching the apparatus 10 to the ATV 14, the implement can be connected to the swingable portion 26 as previously described herein by means of the quick attachment 38, and operatively connecting the auxiliary power source 50 to the mechanized implement 100 by attaching the second shaft 56. Preferably, the implement 100 is a mechanized implement which is connected to and powered by the auxiliary power source 56. Such mechanized implements 100 include, but are not limited to, a snow removal implement as illustrated in FIG. 5 a rotary broom implement as illustrated in FIG. 6 and a lawn mowing implement and tilling implements. Alternatively, non-mechanized implements are also within the scope of the present invention, including push blades and the like.

As previously mentioned, the swingable portion 26 of the implement attaching apparatus 10 allows the attached implement 100 to be raised or lowered relative to the ground. This allows the implement 100 to be positioned between a lowered working position and a raised transport position, as illustrated by differential arrows 104 in FIG. 6. When in the lowered working position, the attached implement 100 either engages the ground or is allowed to float over the ground when performing a specific operation, such as removing snow when a snow removing implement is attached or cutting grass when a mowing implement is attached. When the attached implement 100 is not in use, or it is desirable to drive the ATV 14 or transport the attached implement 100 to another work site, the implement 100 is raised by the attached winch 28 and brought to the raised transport position, as indicated by differential arrows 104. While in the raised transport position 104, neither the implement attaching apparatus 10 nor the attached implement 100 engage the ground, as only the tires 106 of ATV 14 engage the ground. This allows the ATV 14 to be driven in a regular manner and transport the attached implement without being impeded.

Although the present invention has been described with reference to preferred embodiments, workers skilled in the art will recognize that changes may be made in form and detail without departing from the spirit and scope of the invention.

The invention claimed is:

1. An apparatus for connecting to an all-terrain vehicle (ATV) a mechanized implement operatively connected to an auxiliary power source, the ATV having an undercarriage with a front axle and a rear axle, the apparatus comprising:

a unitary frame connectable to the undercarriage, the frame including a first portion extending past the front axle and a second portion extending past the rear axle, the frame being rigid between the front axle and the rear axle;

a base connected to the second portion of the frame for supporting the auxiliary power source; and a swingable portion pivotally attached to the first portion of the frame, the swingable portion mateable with the mechanized implement to connect the mechanized implement to the ATV, the swingable portion positionable to position the connected mechanized implement between a working position and a non-working position, wherein only the ATV engages the ground when the mechanized implement is positioned towards the non-working position.

2. The apparatus of claim 1 and further comprising:

a pin member spaced-apart from and connected to the frame, the pin member extending substantially parallel to the frame towards the swingable portion; and a bracket attachable to the undercarriage of the ATV, the bracket including a surface defining an aperture for receiving the pin member, whereupon disposing the pin member within the aperture, the first portion of the frame connects to the undercarriage.

3. The apparatus of claim 2 wherein the bracket attaches to a forward portion of the undercarriage proximate the front axle of the ATV.

4. The apparatus of claim 1 wherein the ATV includes a rearwardly extending hitch member connected to the undercarriage proximate the rear axle, the hitch member containing an aperture, the apparatus further comprising first and second spaced-apart plates for receiving the hitch member therebetween, the first and second spaced-apart plates attached to the second portion of the frame, each plate including a surface defining a respective plate aperture, each plate aperture positioned to cooperably align with the other, whereupon disposing the hitch member between the first and second plates, the hitch aperture is cooperably alignable with the plate apertures to receive a fastener to secure the second frame portion to the hitch member.

5. The apparatus of claim 1 wherein the ATV includes a rearwardly extending hitch member connected to the undercarriage proximate the rear axle, the hitch member including an aperture, the apparatus further comprising:

a plate attached to the second portion of the frame; and a securing member connected to and extending away from the plate, the securing member disposable within the aperture of the hitch member, whereupon disposing the securing member within the aperture of the hitch member the plate engages and is supported by the hitch member, thereby securing the second portion of the frame to the ATV.

6. An apparatus for connecting an implement to an all-terrain vehicle (ATV), the ATV having an undercarriage, a front axle, a rear axle and a rearwardly extending hitch positioned beyond the rear axle, the apparatus comprising:

a unitary frame assembly including a first end extending past the front axle and a second end extending past the rear axle when positioned proximate the undercarriage, the frame assembly being rigid between the front axle and the rear axle;

a first attachment mechanism for connecting the first end of the frame assembly to the undercarriage proximate the front axle;

a second attachment mechanism for connecting the second end of the frame assembly to the rear hitch; and a swingable assembly for positioning the implement, the swingable assembly fully attached to the first end of the frame assembly past the front axle and connectable to the implement, the swingable assembly pivotal relative to the first end of the frame assembly.

7. The apparatus of claim 6 wherein the first attachment mechanism comprises a pin member spaced apart a selected distance from and connected to the frame assembly and a first bracket attachable to the undercarriage proximate the front axle of the ATV having a surface defining an aperture for receiving the pin member to connect the first end of the frame assembly to the ATV proximate the front axle.

8. The apparatus of claim 6 wherein rear hitch includes an aperture and the second attachment mechanism comprises:

an upper plate connected to the frame assembly and including a surface defining an aperture; and a lower plate spaced apart from the upper plate, the lower plate connected to the frame assembly and including a surface defining an aperture cooperably aligned with the aperture of the upper plate, whereupon disposing the rear hitch of the ATV between the upper and lower plates, the aperture of the hitch cooperates with the aperture of the upper plate and the lower plate to receive a fastener therethrough and secure the second end of the frame to the ATV.

9. The apparatus of claim 6 wherein the rear hitch includes an aperture and the second attachment mechanism comprises:

a plate connected to the second end of the frame assembly; and a securing member connected to and extending away from the plate, the securing member disposable within the aperture of the hitch member, whereupon disposing the securing member within the aperture of the hitch member the plate engages and is supported by the hitch member, thereby securing the second end of the frame to the ATV.

10. The apparatus of claim 6 and further comprising a mechanism attachable to the ATV and the swingable assembly to lower and raise the swingable assembly, thereby positioning the implement between a respective working and non-working position.

11. The apparatus of claim 10 wherein only the ATV engages the ground when the implement is positioned towards the non-working position.

12. The apparatus of claim 6 wherein the swingable assembly comprises an arm having a proximal end pivotally attached to the first end of the unitary frame and an opposing distal end attachable to the implement, wherein the arm is pivotal to raise and lower the implement.

13. An apparatus for connecting an implement to an all-terrain vehicle (ATV), the ATV having an undercarriage, a front axle, a rear axle and a rearwardly extending hitch positioned beyond the rear axle, the apparatus comprising:

a frame assembly including a first end extending past the front axle and a second end extending past the rear axle when positioned proximate the undercarriage, the frame assembly being rigid between the front axle and the rear axle;

a first attachment mechanism for connecting the first end of the frame assembly to the undercarriage proximate the front axle;

a second attachment mechanism for connecting the second end of the frame assembly to the rear hitch; and a swingable assembly for positioning the implement, the swingable assembly fully attached to the first end of the frame assembly forward of the front axle and connectable to the implement.

14. The apparatus of claim 13 wherein the first attachment mechanism comprises a pin member spaced apart a selected distance from and connected to the frame assembly and a first bracket attachable to the undercarriage proximate the front axle of the ATV having a surface defining an aperture for receiving the pin member to connect the first end of the frame assembly to the ATV proximate the front axle.

15. The apparatus of claim 14 wherein the rear hitch includes an aperture and the second attachment mechanism comprises:

a plate connected to the second end of the frame assembly; and a securing member connected to and extending away from the plate, the securing member disposable within the aperture of the hitch member, whereupon disposing the securing member within the aperture of the hitch member the plate engages and is supported by the hitch member, thereby securing the second end of the frame to the ATV.

16. The apparatus of claim 14 wherein the rear hitch includes an aperture and the second attachment mechanism comprises:

an upper plate connected to the frame assembly and including a surface defining an aperture; and a lower plate spaced apart from the upper plate, the lower plate connected to the frame assembly and including a surface defining an aperture cooperably aligned with the aperture of the upper plate, whereupon disposing the rear hitch of the ATV between the upper and lower plates, the aperture of the hitch cooperates with the aperture of the upper plate and the lower plate to receive a fastener therethrough and secure the second end of the frame to the ATV.

17. The apparatus of claim 13 wherein the swingable assembly pivotally attaches to the first end of the frame assembly forward of the front axle.

18. The apparatus of claim 17 wherein the swingable assembly comprises first and second spaced-apart arms, wherein a proximal end of each arm pivotally attaches to the first end of the unitary frame, wherein an opposing distal end of each arm is attachable to the implement, wherein the arms are pivotal to raise and lower the implement.

19. The apparatus of claim 17 and further comprising a mechanism attachable to the ATV and the swingable assembly to lower and raise the swingable assembly, thereby positioning the implement between a respective working and non-working position.

20. The apparatus of claim 19 wherein only the ATV engages the ground when the implement is positioned towards the non-working position.

* * * * *